US008444853B2

(12) United States Patent
Popov

(10) Patent No.: US 8,444,853 B2
(45) Date of Patent: May 21, 2013

(54) LEO-POLARIZER FOR TREATING A FLUID FLOW BY MAGNETIC FIELD

(76) Inventor: Lev Nikolaevich Popov, Tula (RU)

( * ) Notice: Subject to any disclaimer, the term of this patent is extended or adjusted under 35 U.S.C. 154(b) by 500 days.

(21) Appl. No.: 12/799,597

(22) Filed: Apr. 28, 2010

(65) Prior Publication Data

US 2011/0203932 A1 Aug. 25, 2011

Related U.S. Application Data

(60) Provisional application No. 61/338,667, filed on Feb. 22, 2010.

(51) Int. Cl.
*B03C 5/02* (2006.01)
*F02M 33/00* (2006.01)

(52) U.S. Cl.
USPC ..... 210/222; 210/695; 123/536; 123/538

(58) Field of Classification Search
USPC ..... 210/222, 695; 123/536, 538
See application file for complete search history.

(56) References Cited

U.S. PATENT DOCUMENTS 3,116,726 A 1/1964 Kwartz
3,228,868 A 1/1966 Riskin et al.
3,349,354 A 10/1967 Miyata
3,762,135 A 10/1973 Ikebe et al.
3,830,621 A 8/1974 Miller
3,893,437 A 7/1975 Ries et al.
3,989,017 A 11/1976 Reece
4,005,683 A 2/1977 Whitt
4,050,426 A 9/1977 Sanderson
4,188,296 A 2/1980 Fujita
4,308,847 A 1/1982 Ruizzo
4,334,887 A 6/1982 Frank et al.
4,372,852 A 2/1983 Kovacs
4,381,754 A 5/1983 Heckel
4,414,951 A 11/1983 Saneto
4,424,786 A 1/1984 Imbert
4,460,516 A 7/1984 Kapitanov et al.
4,461,262 A 7/1984 Chow
4,469,076 A 9/1984 Wolff
4,538,582 A 9/1985 Wakuta
4,568,901 A 2/1986 Adam
4,572,145 A 2/1986 Mitchell et al.
4,956,084 A 9/1990 Stevens
4,995,425 A 2/1991 Weisenbarger et al.
5,059,743 A 10/1991 Sakuma
5,129,382 A 7/1992 Stamps et al.
5,161,512 A 11/1992 Adam et al.
5,271,369 A 12/1993 Melendrez (Continued)

*Primary Examiner* — David A Reifsnyder
(74) *Attorney, Agent, or Firm* — Aleksandr Smushkovich

(57) ABSTRACT

A device for magnetic treatment of a fluid flow preferably comprises a spirally-shaped conduit having spiral turns with a null step therebetween, and a cross-section for passing the flow therethrough, inner magnets internally circumferentially surrounding the turns coupled to the conduit, outer magnets externally circumferentially surrounding the turn. Each inner magnet is situated opposite to a respective counterpart outer magnet, so that the North (or South) pole of the inner magnet faces the South (or North) pole of the counterpart magnet. The magnets can be made of specific sizes, materials, covered by magnetic yokes. In a multi-layer embodiment, the device comprises a steel tube enclosed into and supporting an inner cylindrical magnet, a spirally-shaped conduit consisting of a number of layers, and rows of outer magnets consisting of magnets circumferentially surrounding predeterminedly chosen layers, and having magnetic fluxes uniformly directed either from or to the center of the cylindrical magnet.

7 Claims, 7 Drawing Sheets

U.S. PATENT DOCUMENTS 5,320,751 A 6/1994 Burns
5,331,807 A 7/1994 Hricak
5,460,144 A 10/1995 Park et al.
5,502,425 A 3/1996 Tsai
5,536,401 A 7/1996 Burns
5,558,765 A 9/1996 Twardzik
5,566,661 A 10/1996 Zorita
5,637,226 A * 6/1997 Adam et al. ..... 210/222
5,664,546 A 9/1997 De La Torre Barreiro
5,671,719 A 9/1997 Jeong
5,673,674 A 10/1997 Monteiro Vieira
5,716,520 A 2/1998 Mason
5,795,470 A 8/1998 Wang et al.
5,816,227 A 10/1998 Cronk
5,943,998 A 8/1999 Brown et al.
5,992,398 A 11/1999 Ho
6,000,382 A 12/1999 Albisetti
6,024,073 A 2/2000 Butt
6,041,763 A 3/2000 Akyildiz
6,158,421 A 12/2000 Hsieh et al.
6,178,953 B1 1/2001 Cox
6,220,231 B1 4/2001 Kobayashi
6,386,187 B1 5/2002 Phykitt
6,394,075 B2 5/2002 Castaldini
6,596,163 B1 7/2003 Parker
6,763,811 B1 7/2004 Tamol
6,831,540 B1 12/2004 Lin
6,851,413 B1 2/2005 Tamol
6,890,432 B1 5/2005 Witz et al.
6,901,917 B2 6/2005 Muller
7,331,336 B2 2/2008 Hricak
2009/0308360 A1 12/2009 Istrati et al.

* cited by examiner

LEO-POLARIZER FOR TREATING A FLUID FLOW BY MAGNETIC FIELD

CROSS-REFERENCE TO RELATED APPLICATIONS

The present nonprovisional patent application claims the benefit of a U.S. provisional patent application No. 61/338,667 filed on Feb. 22, 2010, the disclosure of which is hereby incorporated in its entirety by reference.

FIELD OF THE INVENTION

The present invention relates to the field of physics, specifically to methods and devices utilizing an impact of magnetic field upon a fluid (liquid or gas) flow.

BACKGROUND OF THE INVENTION

Treatment of liquids and gases by magnetic field is well known and has been described in many patents. Exemplarily, such treatment is known to essentially alter fuel properties, which leads to better combustion of the fuel, etc. This invention however opens up a new approach to designing devices capable of efficient magnetic treating the fluid flows, such as hydrocarbon fuel (liquid or gas), a seawater solution, and so on.

BRIEF SUMMARY OF THE INVENTION

The subject matter, disclosed in the present application, relates to an inventive device, herein called "Leopolarizer", capable of creating a cyclical (periodical) impact of a magnetic field upon a fluid flow. The device is characterized by a novel and unobvious combination of a spirally-shaped conduit, conducting the fluid flow, with a plurality of permanent (or electrical) magnets disposed in directions substantially radial to the fluid flow along the conduit. The effective magnetic treatment of the fluid is provided due to a specific arrangement of the conduit and the magnets, as well as certain relationships between the conduit's size and the magnets' sizes.

The principle of operation of Leopolarizer is based on the following: an operating medium (fluid flow) moves within the spirally-shaped conduit. While crossing the magnetic field, molecules of the fluid get aligned essentially at a certain direction that substantially prevents them from joining each other and integrating into larger associations, which usually relates to changing certain factors of a technological process involving the fluid flow. Such factors might be: temperature, velocity, pressure, viscosity, concentration of salts, reagent diffusion, liquid surface tension, and others. The magnetic treatment of the fluid (liquid) flow also allows increasing the number of crystallization centers in the fluid, that is the fluid becomes more homogeneous. In this way, the inventive device provides for intensive magnetization and homogenization of the fluid.

In case where the fluid is a liquid fuel for a combustion engine (an internal combustion engine or a diesel engine), the magnetic treatment leads to reduction of emission of the engine, and to raising its combustion efficiency. The device will allow treating large quantities of fuel on gasoline stations, etc., inexpensively and without noticeable maintenance costs.

The inventive device is capable of preventing or gradually eliminating the existing solid deposits in the fuel equipment of any diesel engine or an internal-combustion engine, in conduits of the fuel system, or in the heating and cooling systems.

The inventive device is also capable of accelerating the reagent diffusion, decreasing the liquid surface tension (effect of melting water), reducing the load in exhaust purification systems and devices.

The inventive device can be usefully applied in aircraft; marine and river ships; road and off-road motor vehicles; rail-road transportation means; heat-power engineering (including nuclear power engineering); petrochemical production and petrochemical product pipeline transportation; at seaports' oil loading and unloading terminals; railway stations and warehouses; at refueling stations; in household tanks, boilers, and engines.

The inventive device has the following distinct features: (a) it utilizes the spirally-shaped conduit with a predetermined step (preferably with an essentially null step) of the spiral; (b) the spirally-shaped conduit is preferably made of the following materials: aluminum, aluminum with nitric oxide or a chloral iron manganese coating, paramagnets having magnetic properties at the room temperature, or any other non-magnetic materials; (c) the cross-section of the conduit preferably has a rectangular shape, while a circular shape can also be used for relatively small cross-sections; (d) the Leopolarizer can include a suitable number of layers of the spirally-shaped conduit; (e) a pipe conducting the fluid flow can be furnished with a suitable number of Leopolarizers; (f) the cross-section of the magnets can be of a segmental or rectangular shape, while the length of the magnets can be as long as necessary; (g) the magnets can be preferably made of alloy materials based on neodymium, iron, and boron, or on samarium-cobalt for high temperature conditions; (h) the magnetic field is characterized by discrete and long-term action, as well as multiple sequential application to the same fluid flow due to an arrangement of pairs of inner and outer magnets, wherein polarities of any two adjacent (neighboring) pairs are mutually opposite; (i) the size and power of the device can be adjusted in wide ranges; (j) the magnets preferably have no direct contact with the fluid flow, if necessary the magnets can be painted with rust-preventing stain.

In a preferred embodiment, the inventive device comprises a spirally-shaped conduit having spiral turns with a preferably zero step therebetween, and a cross-section for passing the flow therethrough; inner magnets internally circumferentially surrounding the turns; and outer magnets externally circumferentially surrounding the turns. Each inner magnet is situated opposite to a respective counterpart outer magnet, so that the North (or South) pole of the inner magnet faces the South (or North) pole of the counterpart magnet. The magnets can be made of specific materials, sizes, covered by magnetic yokes. In a multi-layer embodiment, the device comprises a steel tube enclosed into and supporting an inner cylindrical magnet; a spirally-shaped conduit consisting of a number of layers; and rows of outer magnets consisting of magnets circumferentially surrounding predeterminedly chosen layers, and having magnetic fluxes uniformly directed either from or to the center of cylindrical magnet.

PREFERRED EMBODIMENTS OF THE PRESENT INVENTION

Figure 1:
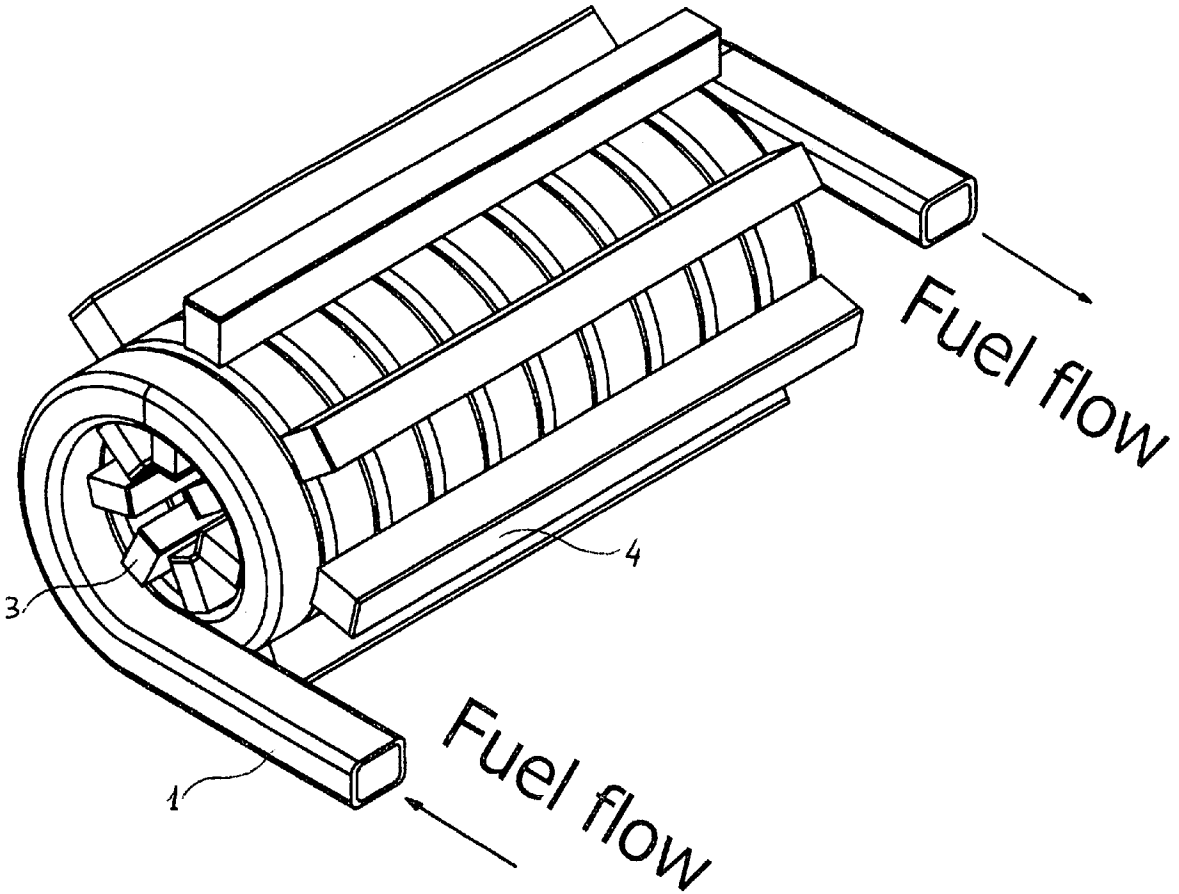
FIG. 1 illustrates a general perspective view of the inventive device, according to an embodiment of the present invention.

While the invention may be susceptible to embodiment in different forms, there are shown in the drawings, and will be described in detail herein, specific embodiments of the present invention, with the understanding that the present disclosure is to be considered an exemplification of the principles of the invention, and is not intended to limit the invention to that as illustrated and described herein.

Figure 2:
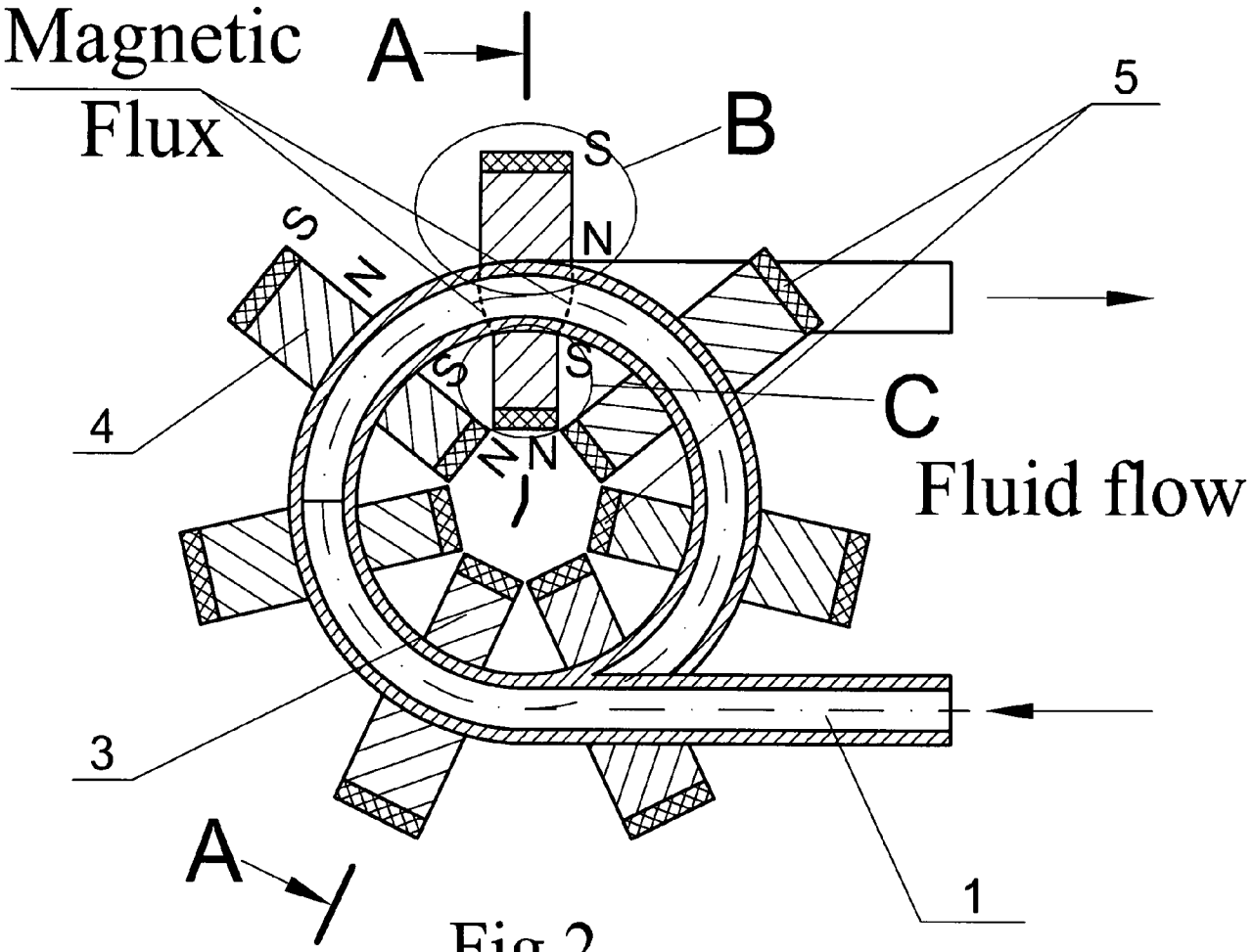
FIG. 2 illustrates a transversal sectional view of the inventive device, according to the embodiment of the present invention shown on FIG. 1.
Figure 3:
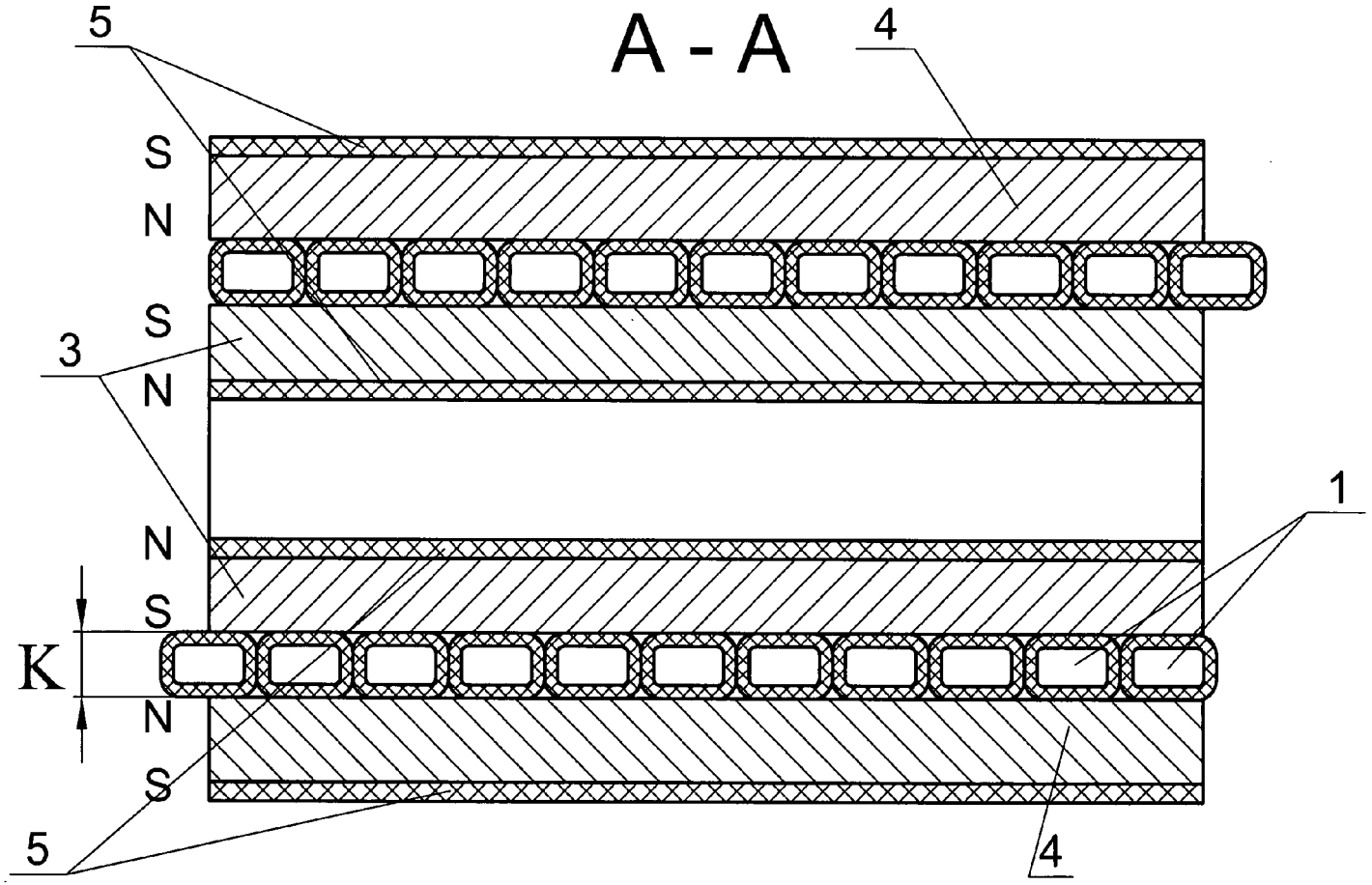
FIG. 3 illustrates a longitudinal sectional view of the inventive device, according to the embodiment of the present invention shown on FIG. 1.

Referring to an embodiment illustrated on FIGS. 1, 2, and 3, the inventive device (single Leopolarizer) for magnetic treatment of a fluid flow comprises a spirally-shaped conduit (1). The fluid flow is passed through the conduit 1. The cross-section of conduit 1 preferably has a rectangular shape with a predetermined height 'K' (shown on FIG. 3), or, in alternative embodiments, a circular shape with a predetermined diameter 'K' (not shown).

The conduit 1 has a predetermined plurality of spiral turns, the turns have a predetermined diameter. Each such turn is circumferentially surrounded with an inner row of magnets and an outer row of magnets. The inner row consists of a plurality of inner magnets (3), whereas the outer row consists of a plurality of outer magnets (4). The number of inner magnets 3 is equal to the number of outer magnets 4. The inner magnets 3 and the outer magnets 4 are preferably fixedly coupled to the conduit 1.

Figure 4:
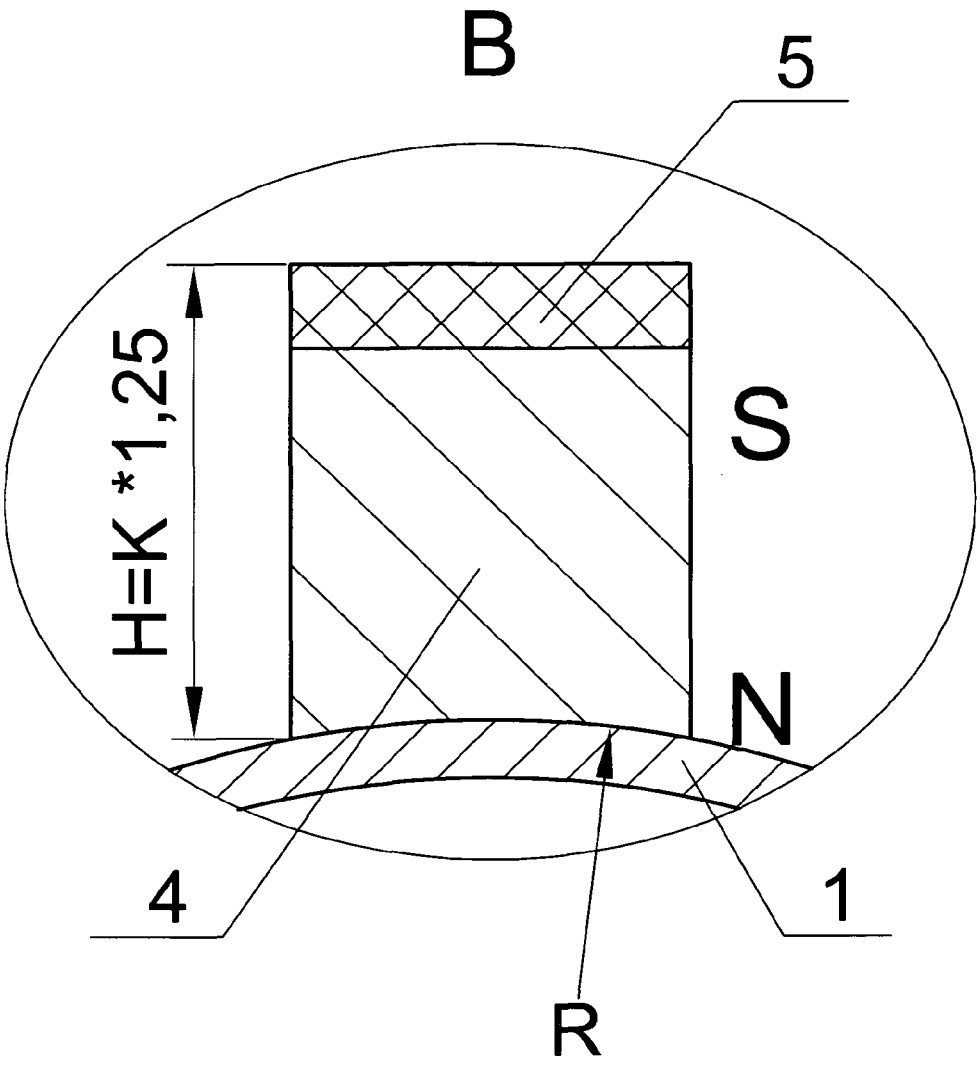
FIG. 4 illustrates a transversal sectional view of an outer magnet of the inventive device, wherein the outer magnet has a cylindrical concave pole with certain dimensions, according to an embodiment of the present invention.
Figure 5:
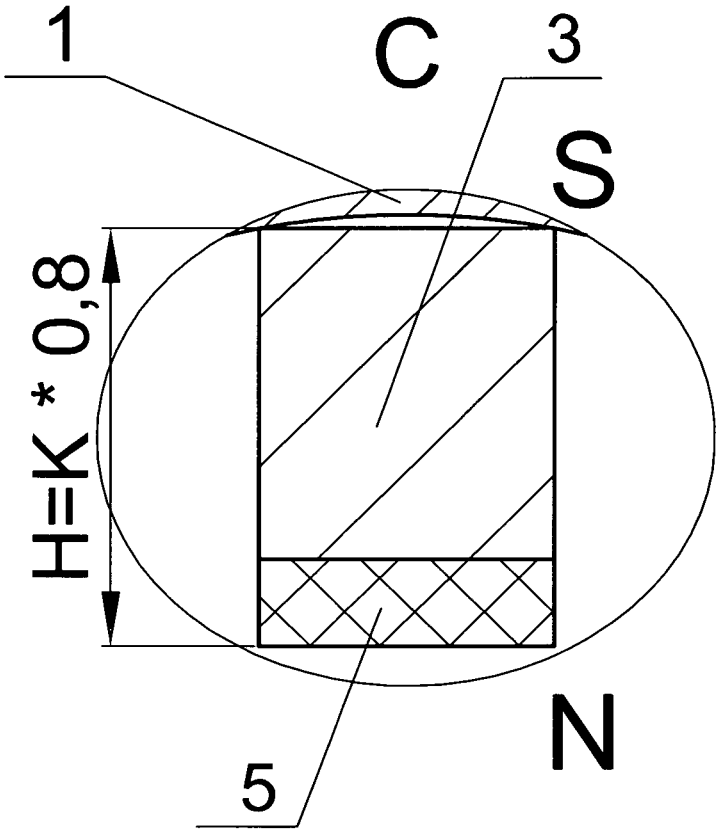
FIG. 5 illustrates a transversal sectional view of an inner magnet of the inventive device, wherein the inner magnet has a rectangular shape with certain dimensions, according to an embodiment of the present invention.

Each inner magnet 3 is situated opposite to a respective counterpart outer magnet 4, so that the North (or South) pole of the magnet 3 faces the South (or North) pole of the respective counterpart magnet 4 (as shown on FIG. 2). Each outer magnet 4 preferably has a concave pole (being a portion of a cylindrical surface) with a radius 'R' (as shown on FIG. 4), whereas each inner magnet 3 preferably has a rectangular shape (as shown on FIG. 5). A height of the inner magnet 3 is preferably equal to 80% of the height K, whereas the height of the outer magnet 4 is preferably equal to 125% of the height K.

In preferred embodiments (as shown on FIG. 2), each two neighboring outer magnets 4 have a magnetic flux directed to (or alternatively from—not shown) the center of the corresponding turn of the conduit 1; and each two neighboring inner magnets 3 have a magnetic flux directed from (or respectively to) the center of the corresponding turn of the conduit 1.

Figure 7:
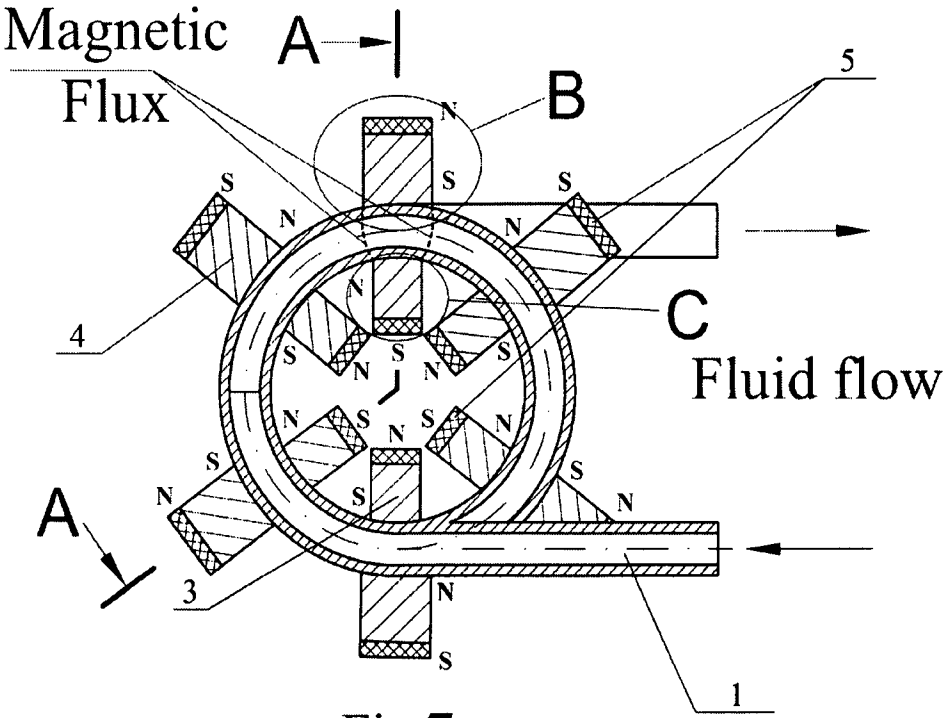
FIG. 7 illustrates a transversal sectional view of the inventive device, according to an embodiment of the present invention with an arrangement of pairs of inner and outer magnets, wherein polarities of any two adjacent (neighboring) pairs are mutually opposite. Identical reference numerals on the drawings generally refer to the same elements, unless otherwise is stated in the description. A newly introduced numeral in the description is enclosed into parentheses.

In alternative embodiments (FIG. 7), each two neighboring magnets 4 (and each two corresponding neighboring magnets 3) may have an opposite alignment of the magnetic field. In the other words, if the magnetic flux of any outer magnet 4 (or any inner magnet 3) is directed to the center of the corresponding turn of the conduit 1, then each outer magnet 4 (or each inner magnet 3) situated adjacently to the magnet 4 (or to the magnet 3), has a magnetic flux directed from the center of the corresponding turn of the conduit 1.

The inventive device comprises a plurality of magnetic yokes (5) covering the external surface of outer magnets 4, and covering the internal surface of inner magnets 3. The magnetic yokes 5 preferably have a thickness of 1-2 mm.

In preferred embodiments, this assembly allows creating a magnetic field between the respective inner and outer magnets, such that: (a) the magnetic field is transversally oriented to the fluid flow providing the maximal magnetic impact thereon; (b) the magnetic field is non-uniformed and has a greater density of magnetic flux between the sharp edges of the concave pole of the outer magnet 4 and the corresponding edge points of the counterpart inner magnet 3 (FIG. 2).

Figure 6:
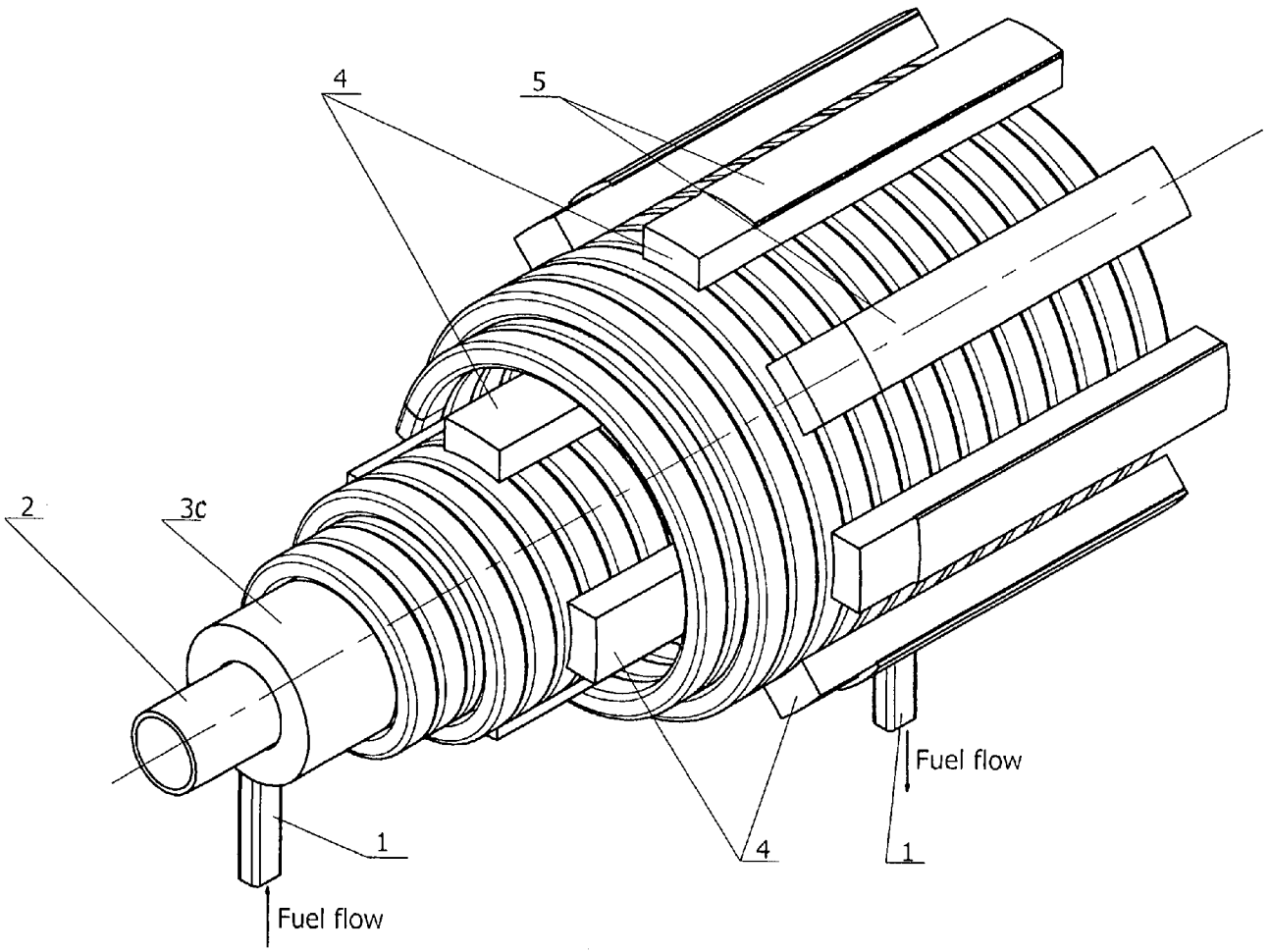
FIG. 6 illustrates a general perspective view of the inventive device having a multi-layer structure, according to an embodiment of the present invention.

A multi-layer embodiment of the inventive device is illustrated on FIG. 6. The device comprises a steel tube (2) enclosed into and supporting an inner cylindrical magnet (3C). The device comprises a conduit 1 consisting of a plurality of spirally-shaped layers sequentially connected to each other, wherein a first layer is enclosed into and supports a second layer, the second layer is enclosed into and supports a third layer, etc. The first spirally-shaped layer of conduit 1 is mounted on the inner cylindrical magnet 3C. A first row of magnets 4 is disposed above a predeterminedly chosen number of layers (e.g. 5 layers of conduit 1, as shown on FIG. 6). A second row of magnets 4 is also disposed above a predeterminedly chosen number of layers (FIG. 6), and so on.

The magnets 4 of the rows are so arranged that the magnetic flux between the inner magnet 3C and the magnets 4 of the first row, the magnetic flux between the magnets of the first row and the magnets of the second row, and so on, are all directed from (or respectively to) the center of the inner magnet 3C, i.e. either inwardly or outwardly. In the other words, the outer magnets 4 have magnetic fluxes uniformly directed either from or to the center of the inner cylindrical magnet 3C.

The plurality of spirally-shaped layers includes a last outermost layer (having the maximal diameter) surrounded by an outermost row of magnets 4 (as shown on FIG. 6). Each magnet 4 of the outermost row of magnets is covered with a magnetic yoke 5. The magnets 4 and the yokes 5 can be attached to each other, as well as to the corresponding layers of conduit 1, with propylene fasteners, a bilateral sticky polymeric tape, and other suitable known means. In some embodiments they can be secured by magnetic forces themselves.

I claim:

1. A device for magnetic treatment of a fluid flow comprising:

a spirally-shaped conduit having:

a predetermined number of spiral turns with a predetermined diameter of the turns, each said turn having an internal surface and an external surface, a predetermined step between said turns, and a predetermined cross-section for passing the fluid flow therethrough;

a plurality of inner magnets circumferentially surrounding each said turn on the internal surface, said inner magnets are substantially coupled to said conduit; and a plurality of outer magnets circumferentially surrounding each said turn on the external surface, said outer magnets are substantially coupled to said conduit; the plurality of outer magnets is equal to the plurality of inner magnets;

wherein:

each said inner magnet is situated opposite to a respective counterpart from said plurality of outer magnets so that the North or (South) pole of the inner magnet faces the South (or North) pole of the counterpart outer magnet;

each said inner magnet includes an internal side facing the center of the corresponding turn; each said internal side is covered by an individual inner magnetic yoke;

each said outer magnet includes an external side, remote from the center of the corresponding turn, each said external side is covered by an individual outer magnetic yoke; and wherein said individual inner magnetic yoke and said individual outer magnetic yoke provide for an individual magnetic field for each pair of said inner magnet and the corresponding said outer magnet; said individual magnetic field is essentially located in a section of the conduit disposed between said inner magnet and said outer magnet of the corresponding pair, and polarities of the individual magnetic fields of any two adjacent pairs are mutually opposite;

thereby providing a plurality of magnetic fields applied to the adjacent sections of said conduit in alternative polarities.

2. The device according to claim 1, wherein said predetermined cross-section of the conduit has a rectangular shape with a height K; each said inner magnet has a cross-section of a rectangular shape with a height equal to 80% of the height K; and each said outer magnet has a cross-section of a rectangular shape with a height equal to 125% of the height K.

3. The device according to claim 1, wherein said predetermined cross-section of the conduit has a circular shape with a diameter K; each said inner magnet has a cross-section of a rectangular shape with a height equal to 80% of the diameter K; and each said outer magnet has a cross-section of a rectangular shape with a height equal to 125% of the diameter K.

4. The device according to claim 1, wherein each two neighboring said outer magnets have a magnetic flux directed to (or from) the center of the corresponding turn of said conduit; and each two neighboring said inner magnets have a magnetic flux directed from (or respectively to) the center of the corresponding turn of said conduit.

5. The device according to claim 1, wherein each said inner magnet has a cross-section of a rectangular shape; whereas each said outer magnet has a concave pole, being a portion of a cylindrical surface, with a predetermined radius.

6. The device according to claim 1, wherein said step is substantially equal to zero.

7. The device according to claim 1, wherein:

said conduit is made of at least one of the following materials: aluminum, aluminum with nitric oxide coating, and aluminum with a chloral iron manganese coating; and said inner and outer magnets are made of an alloy including at least one of the following materials: neodymium, iron, boron, and samarium-cobalt.

* * * * *